US009945522B1

(12) United States Patent
Bryant et al.

(10) Patent No.: US 9,945,522 B1
(45) Date of Patent: Apr. 17, 2018

(54) ADJUSTABLE LIGHT MODULE

(71) Applicants: Christopher Michael Bryant, Social Circle, GA (US); Kevin Charles Broughton, Sharpsburg, GA (US)

(72) Inventors: Christopher Michael Bryant, Social Circle, GA (US); Kevin Charles Broughton, Sharpsburg, GA (US)

(73) Assignee: Cooper Technologies Company, Houston, TX (US)

( * ) Notice: Subject to any disclaimer, the term of this patent is extended or adjusted under 35 U.S.C. 154(b) by 78 days.

(21) Appl. No.: 14/580,020

(22) Filed: Dec. 22, 2014

Related U.S. Application Data

(60) Provisional application No. 61/976,719, filed on Apr. 8, 2014.

(51) Int. Cl.

| | |
|---|---|
| ***F21V 29/00*** | (2015.01) |
| ***F21K 99/00*** | (2016.01) |
| ***F21V 31/00*** | (2006.01) |
| *F21Y 101/02* | (2006.01) |

(52) U.S. Cl.
CPC ..... *F21K 9/58* (2013.01); *F21V 29/22* (2013.01); *F21V 31/005* (2013.01); *F21Y 2101/02* (2013.01)

(58) Field of Classification Search
CPC ..... F21K 9/58; F21V 29/22; F21V 31/005
See application file for complete search history.

(56) References Cited

U.S. PATENT DOCUMENTS

| | | | |
|---|---|---|---|
| 4,549,366 | A | 10/1985 | Gerding |
| 6,042,251 | A | 3/2000 | McCarthy |
| 6,082,878 | A | 7/2000 | Doubek et al. |
| 6,183,104 | B1 | 2/2001 | Ferrara |
| 6,193,395 | B1 | 2/2001 | Logan |
| 6,969,181 | B1 | 11/2005 | Bailey |
| 7,284,880 | B1 | 10/2007 | Steele |
| 7,674,018 | B2 | 3/2010 | Holder et al. |
| 8,002,435 | B2 | 8/2011 | Laporte |
| 2006/0193151 | A1 | 8/2006 | Quan |
| 2008/0266856 | A1 | 10/2008 | Chien |
| 2009/0310356 | A1 | 12/2009 | Laporte |
| 2010/0195326 | A1 | 8/2010 | Boxler |
| 2013/0069100 | A1 | 3/2013 | Ahmed |
| 2014/0340872 | A1 | 11/2014 | Campbell |
| 2015/0176831 | A1 | 6/2015 | Zhang |
| 2015/0369430 | A1 | 12/2015 | Vamberi |

OTHER PUBLICATIONS

International Search Report for PCT/US2015/024767, dated Jul. 9, 2015.
International Search Report for PCT/US2015/024770, dated Jul. 9, 2015.

*Primary Examiner* — Elmito Breval
*Assistant Examiner* — Meghan Ulanday
(74) *Attorney, Agent, or Firm* — King & Spalding LLP

(57) ABSTRACT

A light module can comprise a light emitting diode that generates light and an optic that manipulates or manages the resulting light. The optic can direct the generated light off axis, resulting in an illumination pattern that is biased towards one side of the light module, for example in a desired direction. Thus, the optic can transform the emission pattern of the light emitting diode to create an illumination pattern that is aimed in a desired direction. The optic can comprise a light-blocking shield to suppress, manage, or redirect light that would otherwise emanate from the light module in an unintended direction, for example opposite the desired direction.

19 Claims, 17 Drawing Sheets

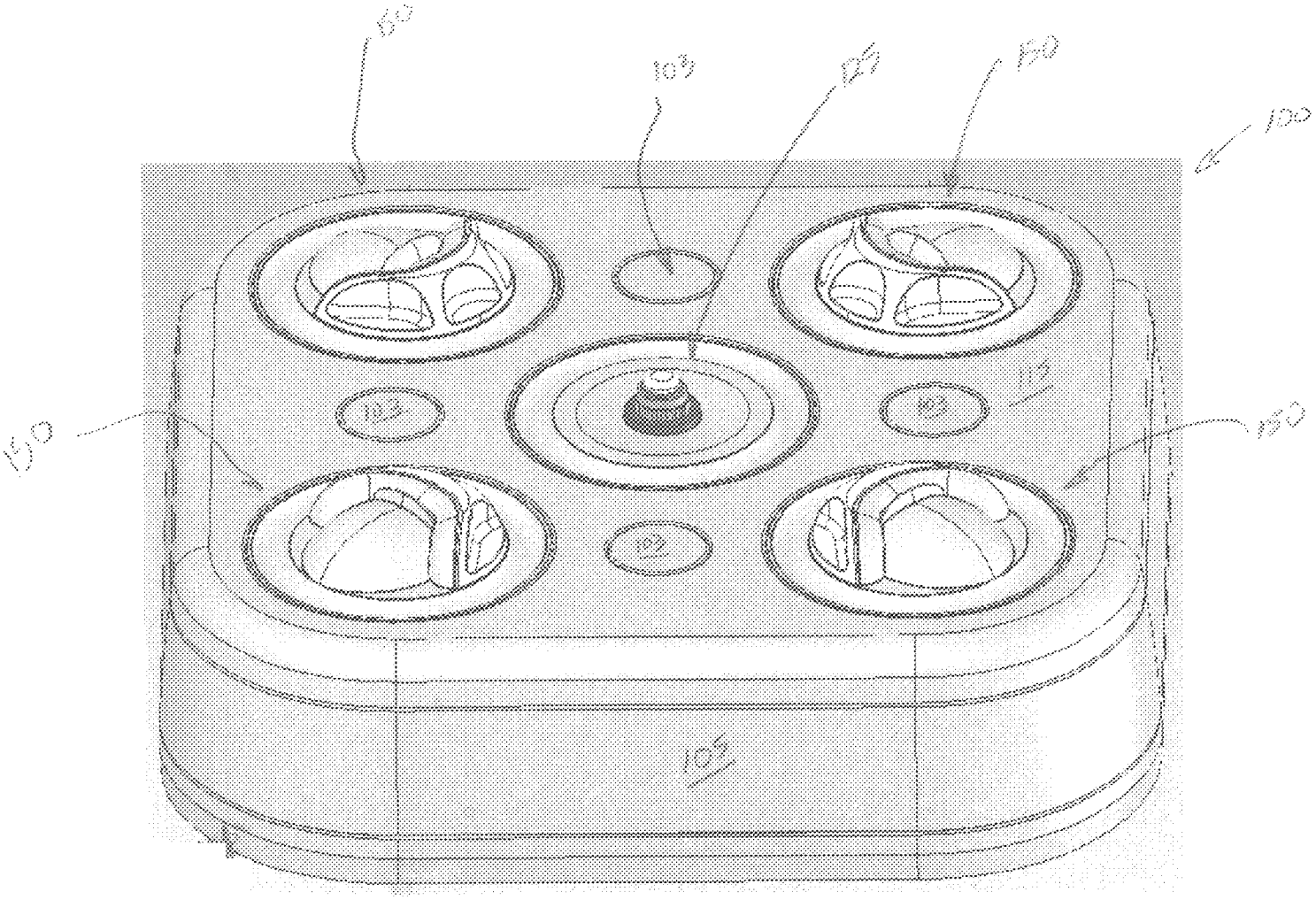
100
102
104
106
108
110
112
114
116
118
120
122
124
126
128
130
132
134
136
138
140
142
144
146
148
150
152
154
156
158
160
162
164
166
168
170
172
174
176
178
180

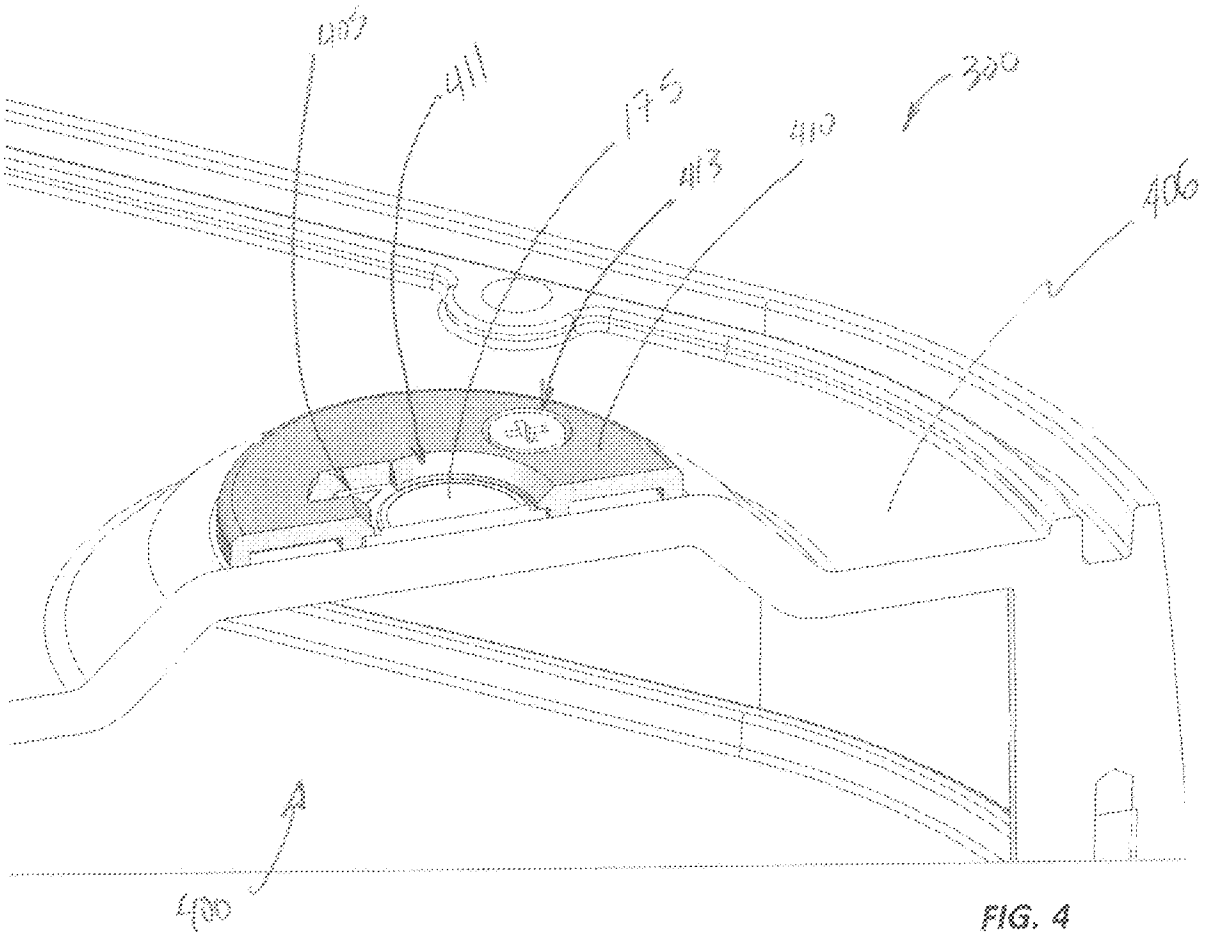
200
40b
40c
40a
40d
40e
40f
40g
40h
40i
40j
40k
40l
40m
40n
40o
40p
40q
40r
40s
40t
40u
40v
40w
40x
40y
40z
40aa
40ab
40ac
40ad
40ae
40af
40ag
40ah
40ai
40aj
40ak
40al
40am
40an
40ao
40ap
40aq
40ar
40as
40at
40au
40av
40aw
40ax
40ay
40az
40ba
40bb
40bc
40bd
40be
40bf
40bg
40bh
40bi
40bj
40bk
40bl
40bm
40bn
40bo
40bp
40bq
40br
40bs
40bt
40bu
40bv
40bw
40bx
40by
40bz
40ca
40cb
40cc
40cd
40ce
40cf
40cg
40ch
40ci
40cj
40ck
40cl
40cm
40cn
40co
40cp
40cq
40cr
40cs
40ct
40cu
40cv
40cw
40cx
40cy
40cz
40da
40db
40dc
40dd
40de
40df
40dg
40dh
40di
40dj
40dk
40dl
40dm
40dn
40do
40dp
40dq
40dr
40ds
40dt
40du
40dv
40dw
40dx
40dy
40dz
40ea
40eb
40ec
40ed
40ee
40ef
40eg
40eh
40ei
40ej
40ek
40el
40em
40en
40eo
40ep
40eq
40er
40es
40et
40eu
40ev
40ew
40ex
40ey
40ez
40fa
40fb
40fc
40fd
40fe
40ff
40fg
40fh
40fi
40fj
40fk
40fl
40fm
40fn
40fo
40fp
40fq
40fr
40fs
40ft
40fu
40fv
40fw
40fx
40fy
40fz
40ga
40gb
40gc
40gd
40ge
40gf
40gg
40gh
40gi
40gj
40gk
40gl
40gm
40gn
40go
40gp
40gq
40gr
40gs
40gt
40gu
40gv
40gw
40gx
40gy
40gz
40ha
40hb
40hc
40hd
40he
40hf
40hg
40hh
40hi
40hj
40hk
40hl
40hm
40hn
40ho
40hp
40hq
40hr
40hs
40ht
40hu
40hv
40hw
40hx
40hy
40hz
40ia
40ib
40ic
40id
40ie
40if
40ig
40ih
40ii
40ij
40ik
40il
40im
40in
40io
40ip
40iq
40ir
40is
40it
40iu
40iv
40iw
40ix
40iy
40iz
40ja
40jb
40jc
40jd
40je
40jf
40jg
40jh
40ji
40jj
40jk
40jl
40jm
40jn
40jo
40jp
40jq
40jr
40js
40jt
40ju
40jv
40jw
40jx
40jy
40jz
40ka
40kb
40kc
40kd
40ke
40kf
40kg
40kh
40ki
40kj
40kk
40kl
40km
40kn
40ko
40kp
40kq
40kr
40ks
40kt
40ku
40kv
40kw
40kx
40ky
40kz
40la
40lb
40lc
40ld
40le
40lf
40lg
40lh
40li
40lj
40lk
40ll
40lm
40ln
40lo
40lp
40lq
40lr
40ls
40lt
40lu
40lv
40lw
40lx
40ly
40lz
40ma
40mb
40mc
40md
40me
40mf
40mg
40mh
40mi
40mj
40mk
40ml
40mm
40mn
40mo
40mp
40mq
40mr
40ms
40mt
40mu
40mv
40mw
40mx
40my
40mz
40na
40nb
40nc
40nd
40ne
40nf
40ng
40nh
40ni
40nj
40nk
40nl
40nm
40nn
40no
40np
40nq
40nr
40ns
40nt
40nu
40nv
40nw
40nx
40ny
40nz
40oa
40ob
40oc
40od
40oe
40of
40og
40oh
40oi
40oj
40ok
40ol
40om
40on
40oo
40op
40oq
40or
40os
40ot
40ou
40ov
40ow
40ox
40oy
40oz
40pa
40pb
40pc
40pd
40pe
40pf
40pg
40ph
40pi
40pj
40pk
40pl
40pm
40pn
40po
40pp
40pq
40pr
40ps
40pt
40pu
40pv
40pw
40px
40py
40pz
40qa
40qb
40qc
40qd
40qe
40qf
40qg
40qh
40qi
40qj
40qk
40ql
40qm
40qn
40qo
40qp
40qq
40qr
40qs
40qt
40qu
40qv
40qw
40qx
40qy
40qz
40ra
40rb
40rc
40rd
40re
40rf
40rg
40rh
40ri
40rj
40rk
40rl
40rm
40rn
40ro
40rp
40rq
40rr
40rs
40rt
40ru
40rv
40rw
40rx
40ry
40rz
40sa
40sb
40sc
40sd
40se
40sf
40sg
40sh
40si
40sj
40sk
40sl
40sm
40sn
40so
40sp
40sq
40sr
40ss
40st
40su
40sv
40sw
40sx
40sy
40sz
40ta
40tb
40tc
40td
40te
40tf
40tg
40th
40ti
40tj
40tk
40tl
40tm
40tn
40to
40tp
40tq
40tr
40ts
40tt
40tu
40tv
40tw
40tx
40ty
40tz
40ua
40ub
40uc
40ud
40ue
40uf
40ug
40uh
40ui
40uj
40uk
40ul
40um
40un
40uo
40up
40uq
40ur
40us
40ut
40uv
40uw
40ux
40uy
40uz
40va
40vb
40vc
40vd
40ve
40vf
40vg
40vh
40vi
40vj
40vk
40vl
40vm
40vn
40vo
40vp
40vq
40vr
40vs
40vt
40vu
40vv
40vw
40vx
40vy
40vz
40wa
40wb
40wc
40wd
40we
40wf
40wg
40wh
40wi
40wj
40wk
40wl
40wm
40wn
40wo
40wp
40wq
40wr
40ws
40wt
40wu
40wv
40ww
40wx
40wy
40wz
40xa
40xb
40xc
40xd
40xe
40xf
40xg
40xh
40xi
40xj
40xk
40xl
40xm
40xn
40xo
40xp
40xq
40xr
40xs
40xt
40xu
40xv
40xw
40xx
40xy
40xz
40ya
40yb
40yc
40yd
40ye
40yf
40yg
40yh
40yi
40yj
40yk
40yl
40ym
40yn
40yo
40yp
40yq
40yr
40ys
40yt
40yu
40yv
40yw
40yx
40yy
40yz
40za
40zb
40zc
40zd
40ze
40zf
40zg
40zh
40zi
40zj
40zk
40zl
40zm
40zn
40zo
40zp
40zq
40zr
40zs
40zt
40zu
40zv
40zw
40zx
40zy
40zz

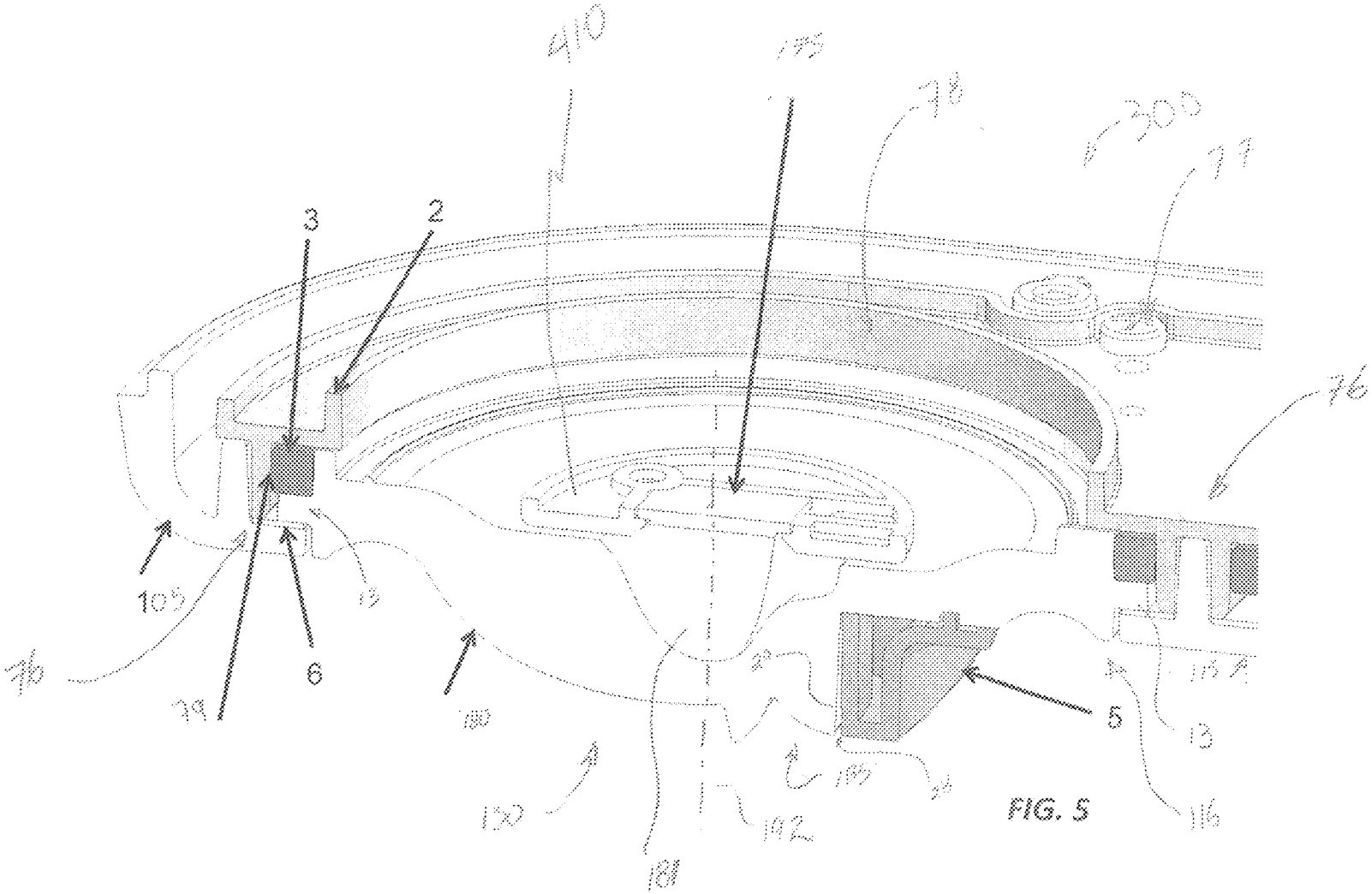
2
3
6
5
13
116
114
200
76
76
76

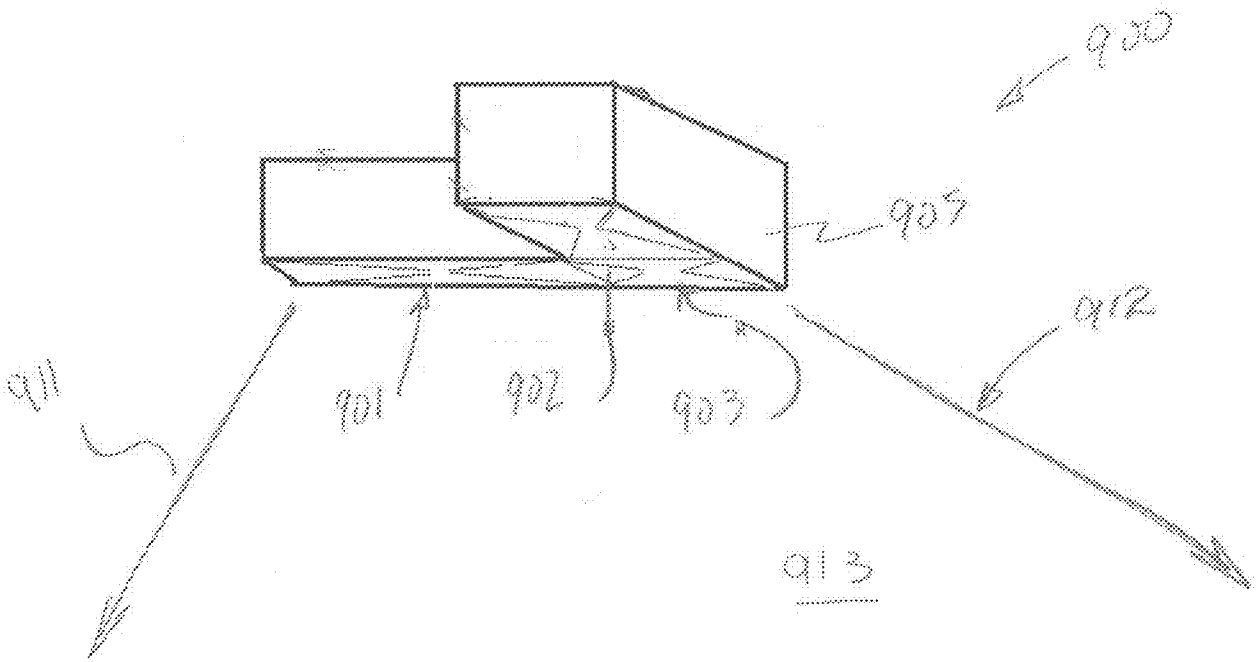
92b
92a
92b
92b
92b

ADJUSTABLE LIGHT MODULE

CROSS REFERENCE TO RELATED APPLICATIONS

The present application claims priority to U.S. Provisional Patent Application No. 61/976,719 filed Apr. 8, 2014 in the name of Christopher Michael Bryant, Westly Davis Hetrick, and Christopher Gerard Ladewig and entitled "Adjustable Luminaire," the entire contents of which are hereby incorporated herein by reference. This application is related to U.S. Non-Provisional patent application Ser. No. 14/580,011, filed concurrently with the present application, having an overlapping inventor list, and entitled "Adjustable Luminaire," the entire contents of which are hereby incorporated herein by reference.

TECHNICAL FIELD

Embodiments of the technology relate generally to light modules, and more particularly to a light module that is rotatable about an axis and that directs light off the axis according to rotational angle to provide directional illumination, for example from one or more light emitting diodes (LEDs).

BACKGROUND

Interest in adoption of light emitting diode technology for illumination is escalating, as light emitting diodes offer advantages over incandescent lighting and other approaches to converting electrical energy into luminous energy. Representative advantages can include longevity and efficiency. Light emitting diodes often come in compact packages that are quite different from conventional incandescent light bulbs or fluorescent bulbs. Additionally, light emitting diodes typically emit light in a quite different geometry than most other conventional illumination sources.

Improved technologies for utilizing light emitting diodes to generate illumination are needed. For example, new technology is needed for configurable, adjustable, or flexible illumination patterns. Need exists for improved luminaires and light modules that can leverage the potential advantages of light emitting diodes. A capability addressing one or more such needs, or some other related deficiency in the art, would support improved illumination systems, better economics, and/or wider use of light emitting diodes.

SUMMARY

A light module can comprise a light emitting diode that generates light and an optic that manipulates the generated light. The optic can direct the generated light off axis, resulting in an illumination pattern that is biased towards one side of the light module, for example in a desired direction. The optic can comprise a light-blocking shield to suppress light that would otherwise emanate from the opposing side of the light module, for example opposite the desired direction.

The foregoing discussion of light modules is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text.

It is intended that all such aspects, systems, methods, features, advantages, and objects are to be included within this description and covered by this application and by the appended claims of the application.

BRIEF DESCRIPTION OF THE DRAWINGS

FIGS. 1A and 1B (collectively FIG. 1) illustrate two views of a luminaire comprising four rotatable light modules according to some example embodiments of the present disclosure.

FIG. 4 illustrates a perspective view of a cross section of a light emitting diode mounting system for a luminaire according to some example embodiments of the present disclosure.

FIG. 5 illustrates a perspective view of a cross section of a rotatable light module mounted in an aperture of a luminaire according to some example embodiments of the present disclosure.

FIG. 9 illustrates a perspective of a luminaire comprising three recessed light modules according to some example embodiments of the present disclosure.

Figure 1B:
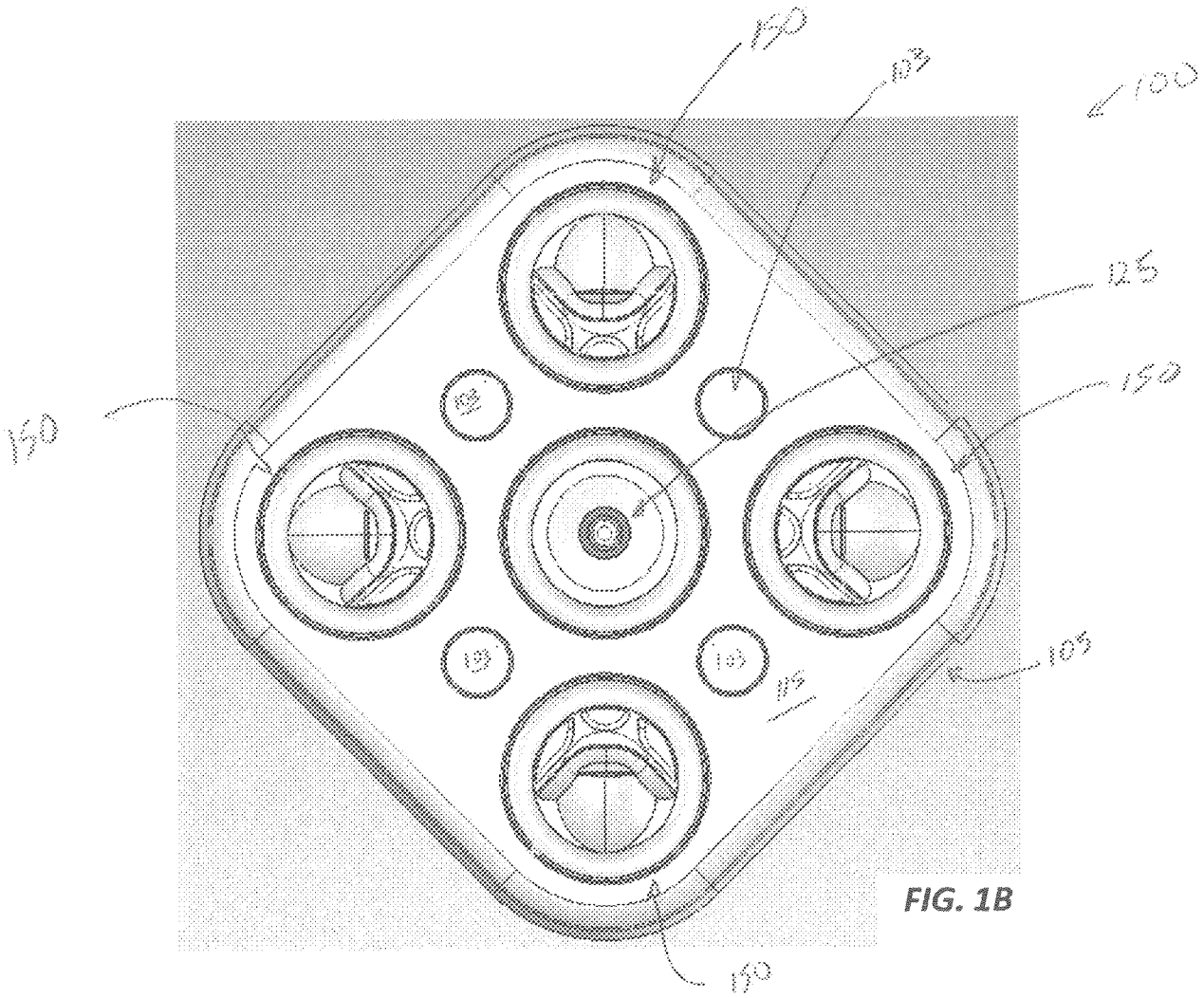

Many aspects of the technology can be better understood with reference to the above drawings. The elements and features shown in the drawings are not necessarily to scale, emphasis being placed upon clearly illustrating the principles of exemplary embodiments of the present technology. Moreover, certain dimensions may be exaggerated to help visually convey such principles.

DETAILED DESCRIPTION OF EXAMPLE EMBODIMENTS

A rotatable light module can be mounted at an enclosure, for example of a luminaire. The rotatable light module can emit light along one axis and rotate about another axis. The two axes can be skewed relative to one another, for example so that the two axes are oriented other than parallel to one another. In some example embodiments, the rotatable light module comprises a stationary light emitting diode and a rotating optic. In some example embodiments, the rotatable light module comprises a light emitting diode and an optic that rotate together.

Some representative embodiments will be described more fully hereinafter with example reference to the accompanying drawings that illustrate some representative embodiments of the disclosure. FIGS. 1, 2, and 3 describe three representative embodiments of luminaires incorporating a rotatable light module. FIGS. 4 and 5 describe representative embodiments for mounting a rotatable light module. FIGS. 6, 7, and 8 describe a representative embodiment of a rotatable light module. FIG. 9 describes another representative embodiment of a luminaire. FIG. 10 describes another representative luminaire embodiment.

The technology may, however, be embodied in many different forms and should not be construed as limited to the embodiments set forth herein; rather, these embodiments are provided so that this disclosure will be thorough and complete, and will fully convey the scope of the technology to those appropriately skilled in the art. The elements and features shown in the drawings are not necessarily drawn to scale, emphasis instead being placed upon clearly illustrating principles of the embodiments. Additionally, certain dimensions or positionings may be exaggerated to help visually convey certain principles. In the drawings, similar reference numerals among different figures designate like or corresponding, but not necessarily identical, elements across the various views.

Referring now to the drawings, FIGS. 1, 2, and 3 illustrate three example luminaires 100, 200, 300 that comprise example rotatable light modules 150 in accordance with some embodiments of the disclosure.

FIG. 1A illustrates a perspective view of the example luminaire 100 that incorporates four rotatable light modules 150. FIG. 1B illustrates a view of the example luminaire 100 that shows the front or light-emitting side.

Figure 2A:
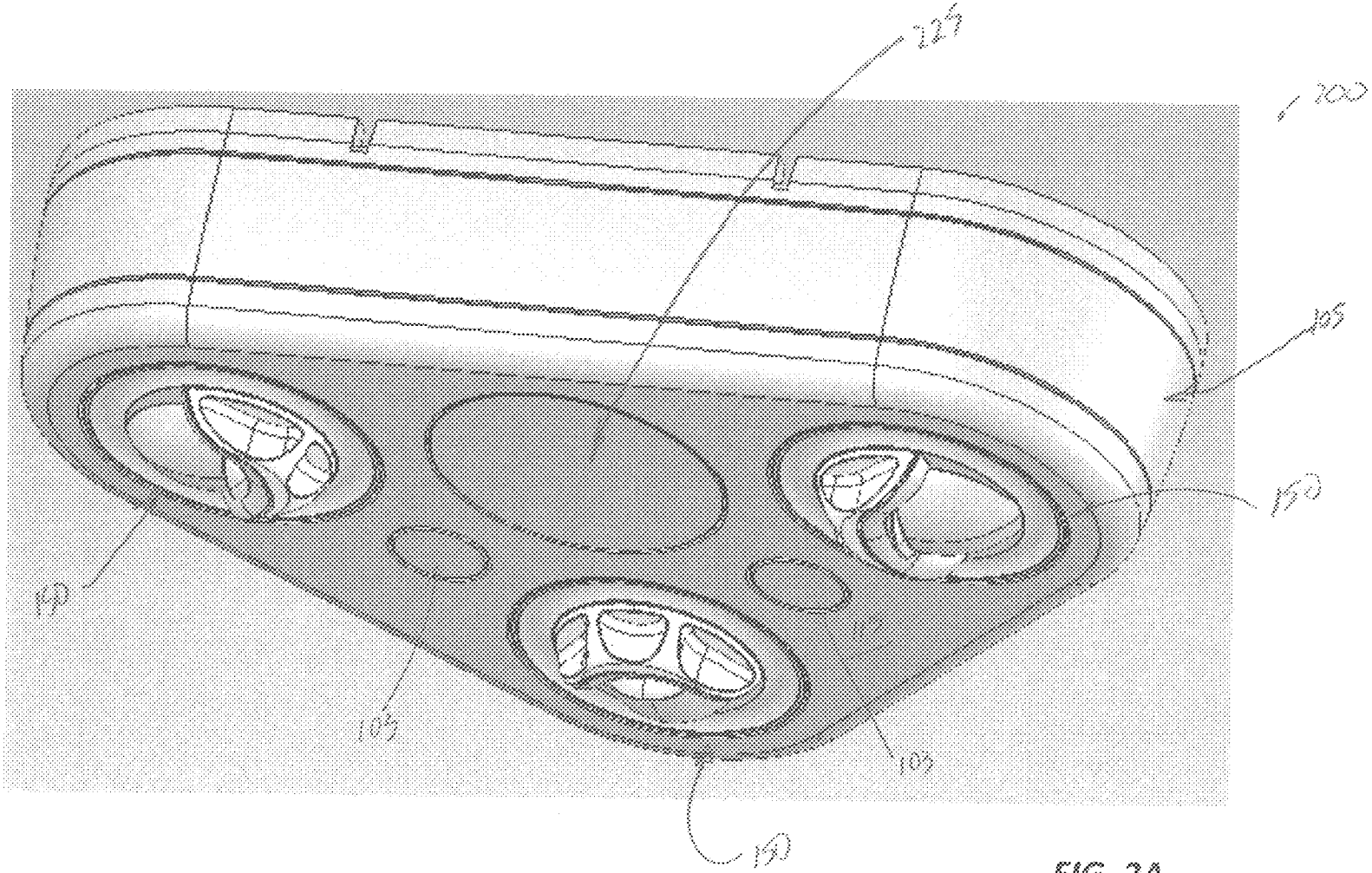
FIGS. 2A and 2B (collectively FIG. 2) illustrate two views of a luminaire comprising three rotatable light modules according to some example embodiments of the present disclosure.
Figure 2B:
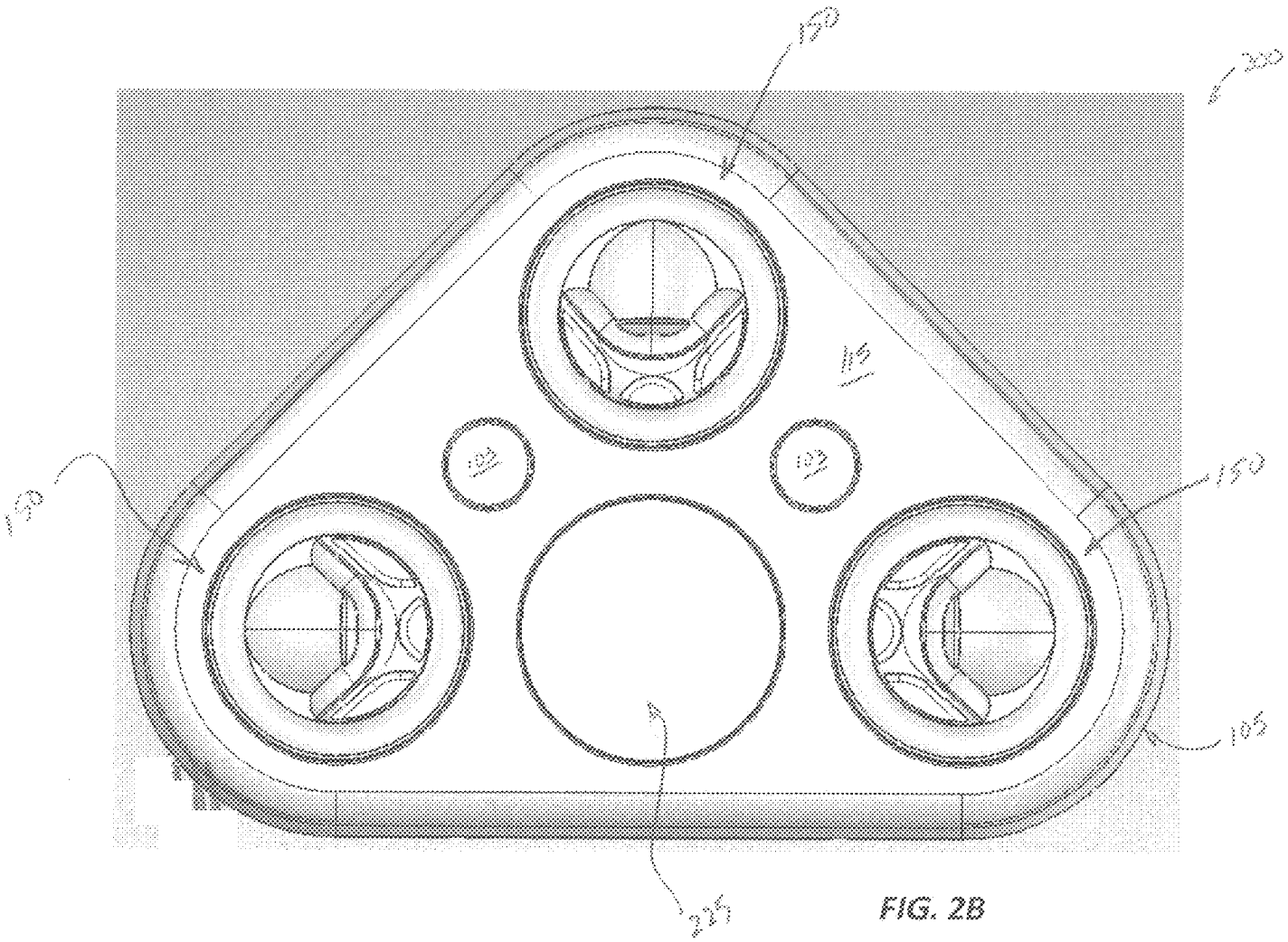

FIG. 2A illustrates a perspective view of the example luminaire 200 that incorporates three rotatable light modules 150. FIG. 2B illustrates a view of the example luminaire 200 that shows the front or light-emitting side.

Figure 3A:
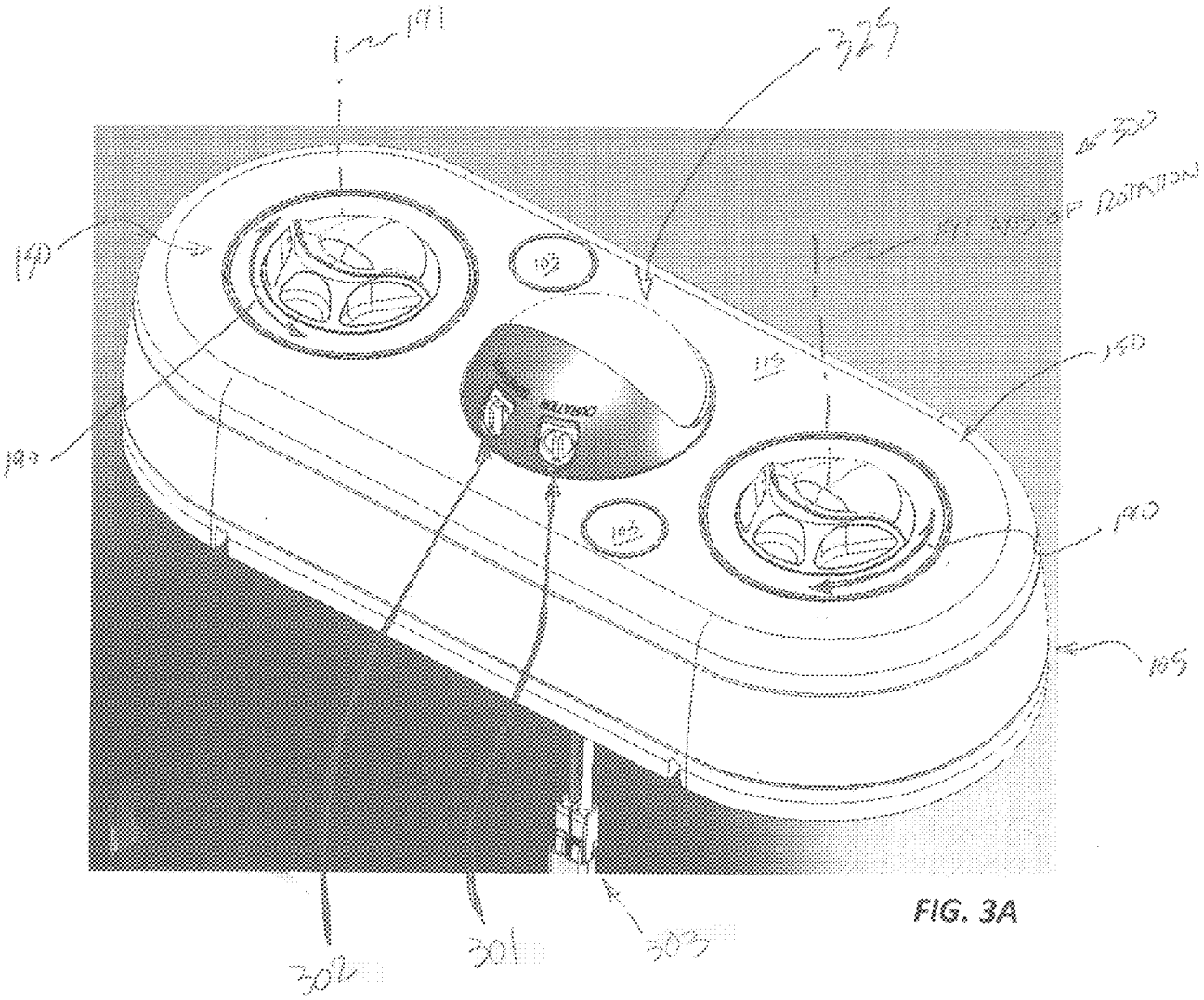
FIGS. 3A, 3B, 3C, and 3D (collectively FIG. 3) illustrate four views of a luminaire comprising two rotatable light modules according to some example embodiments of the present disclosure.
Figure 3B:
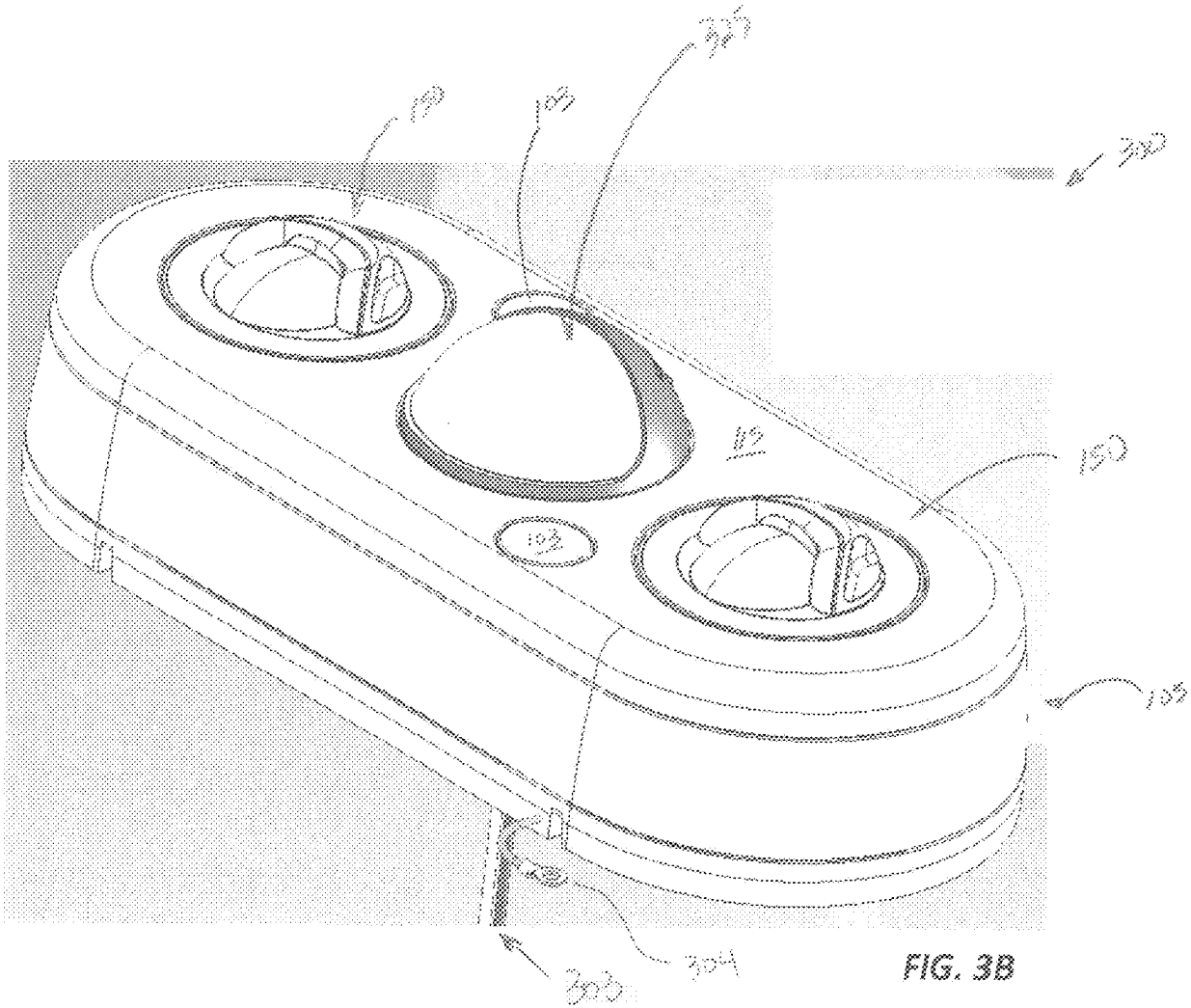
Figure 3C:
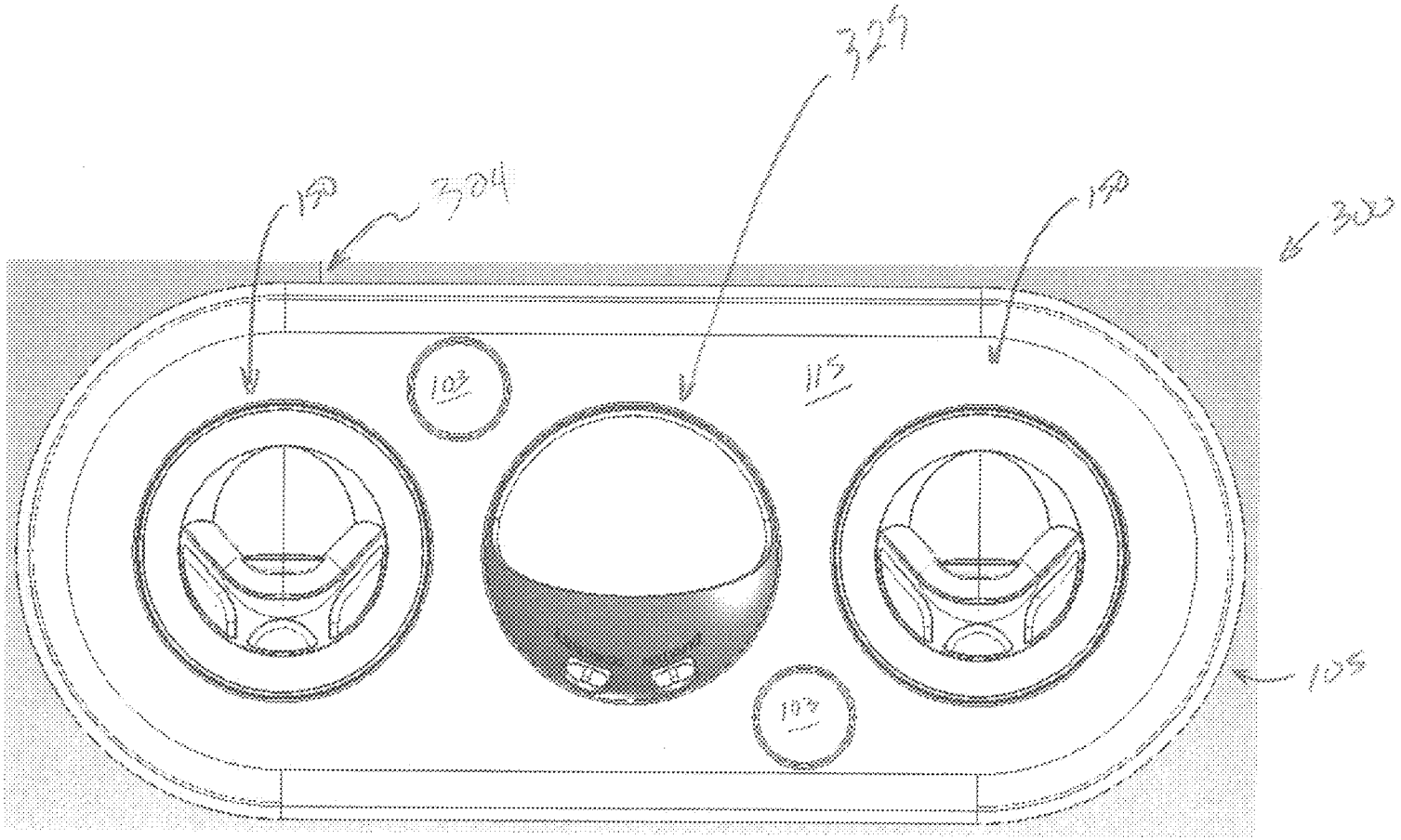
Figure 3D:
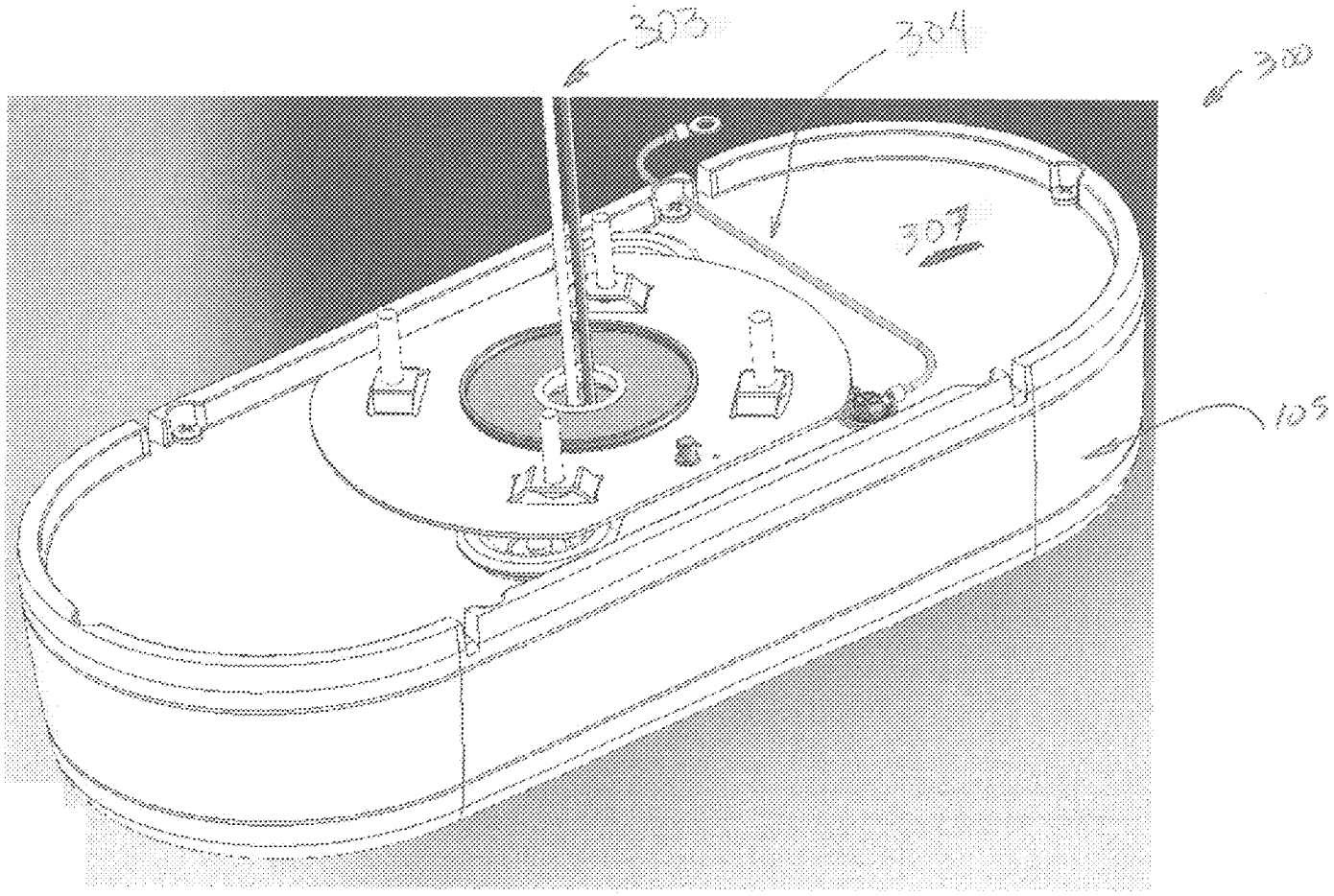

FIG. 3A illustrates a perspective view of the example luminaire 300 that incorporates two rotatable light modules 150. FIG. 3B illustrates another perspective view of the example luminaire 300, from a vantage point on the opposite side of the luminaire 300 relative to the view of FIG. 3A. FIG. 3C illustrates a view of the example luminaire 300 that shows the front or light-emitting side. FIG. 3D illustrates a perspective view of the example luminaire 300, showing the rear side that is opposite the light-emitting side.

In some embodiments, the luminaire 100, 200, 300 can be mounted to an eave of a building or other appropriate structure, for example a residential home or a commercial business. In many such embodiments, the luminaire 100, 200, 300 would typically be installed so that the front or light emitting side (as illustrated in FIGS. 1A, 1B, 2A, 2B, 3A, 3B, and 3C) would face downward, towards the ground. Thus, the rear side, which is illustrated in FIG. 3D, would typically be mounted against the eave with the rear side facing up.

In some embodiments, the luminaire 100, 200, 300 can be mounted to a wall or other vertically oriented structure or surface, and further to structures and surfaces that are slanted relative to horizontal. Various embodiments may be deployed in other indoor and outdoor applications, for example.

Each of the illustrated luminaires 100, 200, 300 comprises a respective housing 105 that comprises a platform 115. The term "platform," as used herein, generally refers to a raised surface or structure. Rotatable light modules 150 are set in respective apertures of the platform 115. Four rotatable light modules 150 are recessed in the platform 115 of the luminaire 100 illustrated in FIG. 1. Three rotatable light modules 150 are recessed in the platform 115 of the luminaire 200 illustrated in FIG. 2. Two rotatable light modules 150 are recessed in the platform 115 of the luminaire 300 illustrated in FIG. 3. In an example embodiment, each rotatable light module 150 is inlaid in the platform 115. A peripheral area of each rotatable light module 150 can maintain a parallel or coplanar orientation with the platform 115 during rotation, for example.

As will be discussed in further detail below, each light module 150 comprises a light emitting diode that can be a chip-on-board light emitting diode or one or more discrete light emitting diodes, for example.

As illustrated in FIG. 3A, the rotational path 190 of each rotatable light module 150 is about an axis 191 that extends through the platform 115. As will be discussed in further detail below, each rotatable light module 150 directs light laterally or sideways relative to the axis 191 of rotation. Accordingly, the optical axis of the rotatable light module 150 and the axis 191 of rotation of the rotatable light module 150 are skewed relative to one another and thus are typically oriented at an angle other than parallel. Rotating each rotatable light module 150 provides a user with a capability to aim the illumination pattern in a desired direction.

In the illustrated embodiments of FIGS. 1, 2, and 3, the rotatable light modules 150 are separately rotatable, for example during installation. An owner of a property at which the luminaire 100, 200, 300 is installed may also rotate the rotatable light modules 150 from time-to-time after installation, for example to provide illumination specific to an event or a task.

With the illumination pattern of each rotatable light module 150 diverging from its respective axis 191 of rotation, the overall illumination of the luminaire 100, 200, 300 can be readily configured via adjusting the rotational positions of the individual light modules 150. For example, when mounted above an area having three picnic tables, the three rotatable light modules 150 of the luminaire 200 could be individually rotated so that each illuminates one of the tables. The three rotatable light modules 150 of the luminaire 200 could also be individually rotated so that all three emit light in a common direction, for example to concentrate illumination on a single picnic table or on a work area, temporarily, for a task.

In some embodiments, the rotation is toothless. In some example embodiments, the rotation is infinitely adjustable. In some example embodiments, the rotation is by designated increments.

In some embodiments each rotatable light module 150 comprises a pointer that serves as a directional indicator of its illumination pattern. With such pointers, a user can conveniently rotate the rotatable light modules 150 to deliver illumination in one or multiple desired directions. For example, with the rotatable light modules 150 set to the rotational orientations shown in FIG. 2, the luminaire 200 will output three individual illumination patterns, each in a different direction.

In some example embodiments, a luminaire can incorporate light modules and/or luminaire technology in accordance with the teachings of U.S. patent application Ser. No. 13/829,014, entitled Three Axis Adjustment for Emergency Lights Emitting an Asymmetric Beam Patterns to Illustrate a Path of Egress and filed Mar. 14, 2013 in the name of Westly Davis Hetrick and Christopher Ladewig, the entire contents of which are hereby incorporated herein by reference. Thus, some embodiments of one or more of the luminaires 100, 200, 300 can incorporate one or more elements, features, teachings, or technologies disclosed in U.S. patent application Ser. No. 13/829,014.

In addition to the rotatable light modules 150, the example luminaire 100 illustrated in FIG. 1 comprises a motion detector 125 that is set in an aperture of the platform 115. In response to sensing movement, the motion detector 125 can activate the rotatable light modules 150 to emit light. In some example embodiments, the motion detector 125 provides omnidirectional sensing. Embodiments of the luminaire 100 may comprise other sensors that control light emission in response to various conditions in accordance with a wide range of applications. As illustrated in FIG. 1, the example luminaire 100 comprises punch-out sites 103 to accommodate such additional sensors or other components.

The example luminaire 200 illustrated in FIG. 2 also comprises punch-out sites 103 for mounting sensors and other elements as may be desired for customization. The luminaire 200 further comprises a large punch-out site for mounting a motion detector, should one be desired.

The example luminaire 300 illustrated in FIG. 3 comprises a user interface 325 that has an integrated motion detector. In an example embodiment, the user interface 325 is rotatable so that the integrated motion detector detects motion in a user-specified direction set by rotation. The user interface 325 comprises two knobs 301, 302 that a user can turn. The knob 301 sets the length of time that the luminaire 300 outputs light when motion is detected. The knob 302 sets motion detector sensitivity so that a user can set the level of detected motion needed to trigger the luminaire 300 to output light.

FIG. 3 further illustrates an example connectorized power cable 303 for supplying the luminaire 300 with electricity. A ground wire 304 is also provided so the luminaire 300 can be readily grounded during installation. As illustrated in FIG. 3D, the wiring is connected to the rear side of the luminaire 300, which can be mounted against an eave or other surface as discussed above. The rear side of the luminaire 300 comprises a cover 307 so that the luminaire 300 is closed on all sides for enhanced environmental protection, including against ingress of moisture, dust, and debris.

Turning now to FIG. 4, this figure is an illustration of a perspective view of a cross section of an example light emitting diode mounting system 400 for the luminaire 300 according to some example embodiments of the present disclosure. In FIG. 4, a cross section of the luminaire 300 is illustrated in the orientation shown in FIG. 3A. That is, so that the light emitting diode 175 would emit light up the page.

As illustrated, a light emitting diode holder 410 mounts the light emitting diode 175 against a heat sink 406, which may be formed of metal or other thermally conductive material and may comprise fins in some embodiments. The rear, non-emitting side of the light emitting diode 175 faces and is in thermal communication with the heat sink 406. Heat thus flows from the light emitting diode 175 into the heat sink 406, with the resulting thermal path leading away from the optic 150, which is shown in FIG. 3A and in FIG. 5, but removed from FIG. 4.

The light emitting diode holder 410 comprises an opening through which light from the light emitting diode 175 passes. A screw 413 fastens the light emitting diode holder 410 to the heat sink 406. The heat sink 406, the light emitting diode 175, and the light emitting diode holder 410 are thus in fixed positions relative to one another, with rotation coming from the associated optical element. A notch 405 in the light emitting diode holder 410 provides passage of an electrical supply lead to the light emitting diode 175.

Turning now to FIG. 5, this figure is an illustration of a perspective view of an example cross section of the example rotatable light module 150 mounted in an aperture of the example luminaire 300 in accordance with some embodiments of the present disclosure. In the illustrated cross section, the cover 307 has been removed from the rear side of the luminaire 300, the heat sink 405, and the electrical supply for the rotatable light module 150 have been eliminated from the view to avoid obstructing visibility of the illustrated features. As illustrated in FIG. 5, the luminaire 300 is vertically inverted relative to the orientation of FIG. 4.

In the illustrated embodiment, an optic 180 that is rotatable covers the light emitting diode 175 and provides environmental/moisture protection in addition to light manipulation. In the illustrated embodiment, the light emitting diode 175 faces and emits light into a cavity 181 of the optic 180. The light emitting diode holder 410 retains the light emitting diode 175 against the heat sink 406 (not illustrated in FIG. 5) as discussed above with respect to FIG. 4.

The optic 180 comprises an internally reflective reflector 185 that redirects light. The light emitting diode 175 emits light along an axis 192, and the internally reflective reflector 185 reflects across the light emitting diode axis 192 light that is incident on the reflector 185. In some example embodiments, the internally reflective reflector 185 can comprise a prism jutting from an outer surface of the optic 180. As illustrated, the internally reflective reflector 185 comprises a totally internally reflective surface 29. Via reflection and refraction, the illustrated optic 180 produces an illumination pattern that is skewed or biased relative to the optical axis 192 of the light emitting diode 175. The illumination pattern may further be skewed or biased relative to the axis of rotation 191 of the associated rotatable light module 150. In operation, the totally internally reflective surface 29 reflects light across the optical axis 192 of the light emitting diode 175 and across the axis of rotation 191 (shown on FIG. 3A) of the rotatable light module 150.

As will be discussed in further detail below, the optic 180 has an associated light-blocking shield 5 that is adjacent but separated from the totally internally reflective surface 29 by an air gap 28. The air gap 28 facilitates total internal reflection at the totally internally reflective surface 29.

In the illustrated embodiment, the light emitting diode 175 is stationary with respect to the optic 180 that rotates and thus may be characterized as a rotatable optic. In other words, the position of the light emitting diode 175 is fixed within the housing 105 of the luminaire 300 while the optic 180 rotates. Thus, the rotatable light module 150 may comprise a stationary light emitting diode 175 and a rotating optic. The optic 180 is set in an aperture 116 of the platform 115 and is rotatable about a central portion of the aperture 116, which is circular in the illustrated embodiment. In some embodiments, coupling a stationary light emitting diode 175 to a rotatable optic 180 provides an opportunity to utilize the luminaire housing 105 for thermal management, for example as a sink for heat generated by LED operation.

As illustrated, the optic 180 comprises a lip 13 that extends around a periphery of the optic 180 and has a diameter that is larger than the diameter of the aperture 116. Thus, the lip 13 captures the optic 180 in the aperture 116, keeping the optic 180 on the underside of the platform 115.

An anti-friction washer 6, which is an example of a ring, circumscribes the aperture 116 and is located between the lip 13 and the underside of the platform 115. A carrier tray 2 is fastened to the underside of the platform 115 with fasteners 77 so that the lip 13 is sandwiched between the carrier tray 2 and the underside of the platform 115. The carrier tray 2 includes an aperture 78 that is aligned with the aperture 116 in the platform. Thus, the optic 180 is aligned with both apertures 116, 78.

A gasket 3 is sandwiched between the lip 13 and the carrier tray 2 to provide a sealing surface 79 that blocks incursion of moisture, dust, and debris. The illustrated gasket 3 is one example embodiment of a ring. The carrier tray 2 and the underside of the platform 115 comprise a system of grooves and protrusions 76 that fit together so that the carrier tray 2 and the underside of the platform 115 are aligned and seated with one another.

In some example embodiments, the optic 180 comprises an optic available from Cooper Lighting (Peachtree City, Ga.) of Eaton Corporation under the trademark ACCULED OPTICS.

Turning now to FIGS. 6, 7, and 8, some example embodiments of the illustrated rotatable light module 150 will be described in further detail below.

Figure 6A:
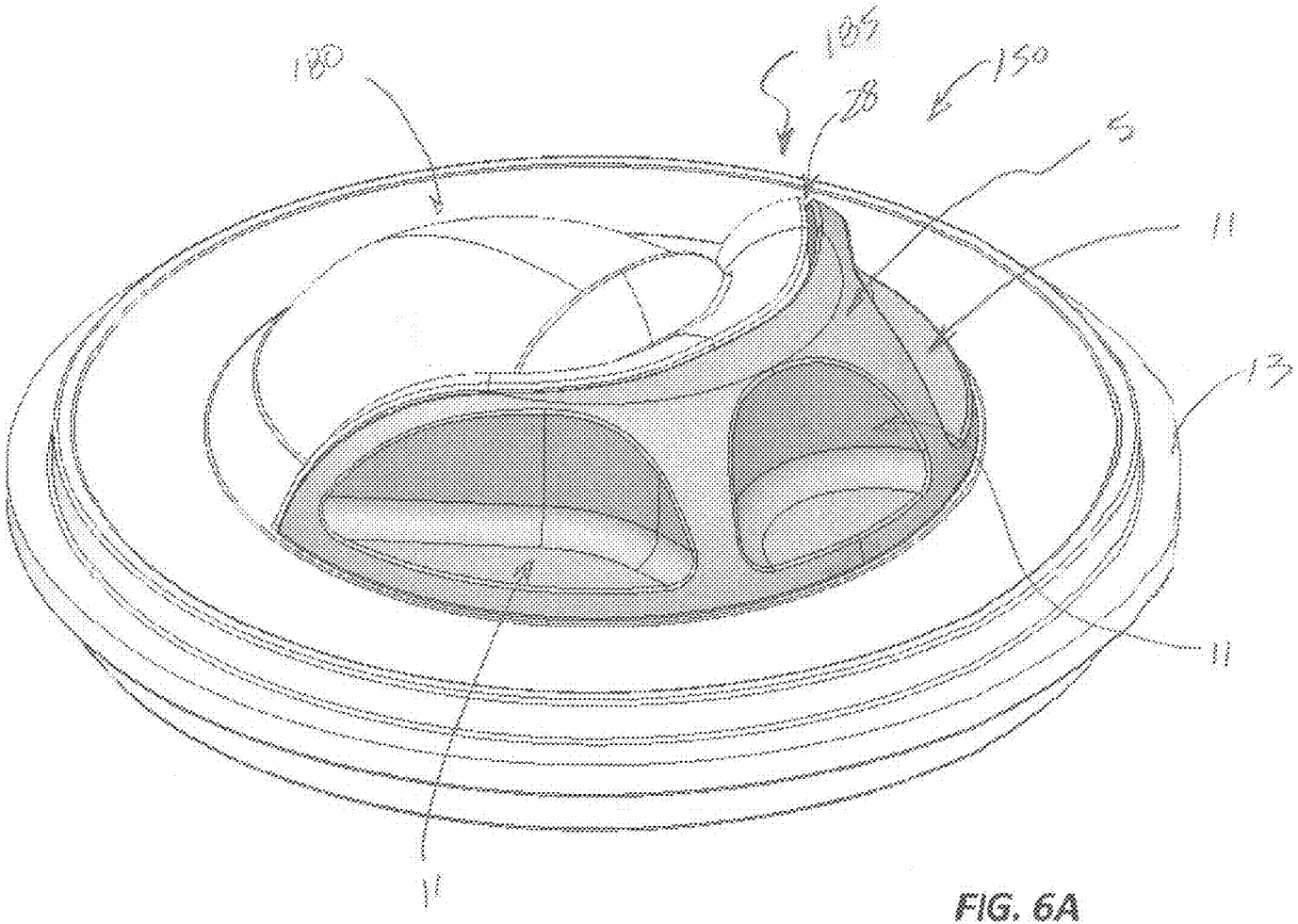
FIGS. 6A, 6B, 6C, and 6D (collectively FIG. 6) illustrate four views of a rotatable light module according to some example embodiments of the present disclosure.
Figure 6C:
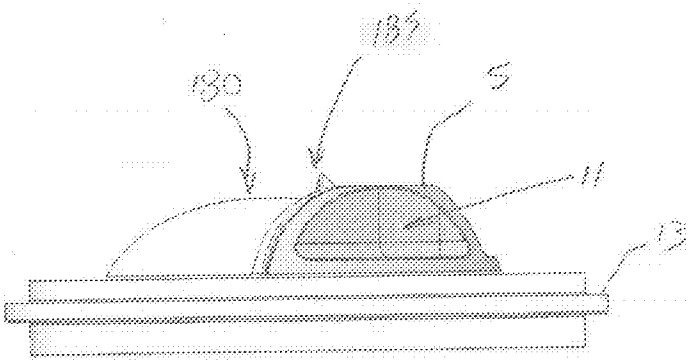
Figure 6D:
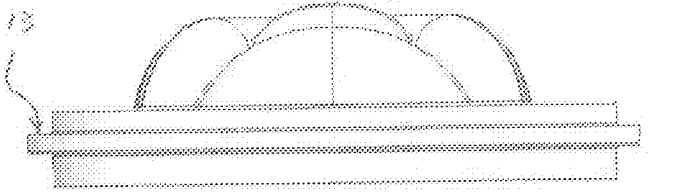
Figure 6B:
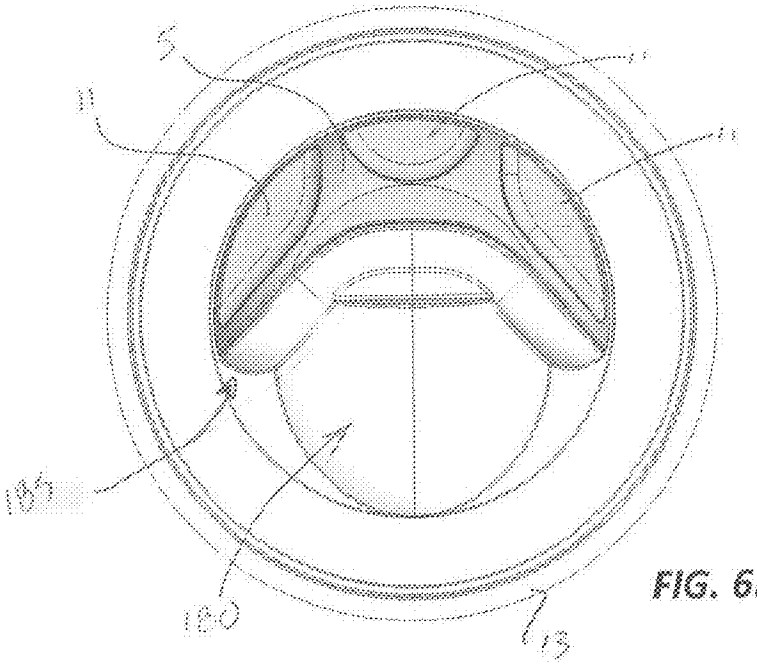
Figure 7B:
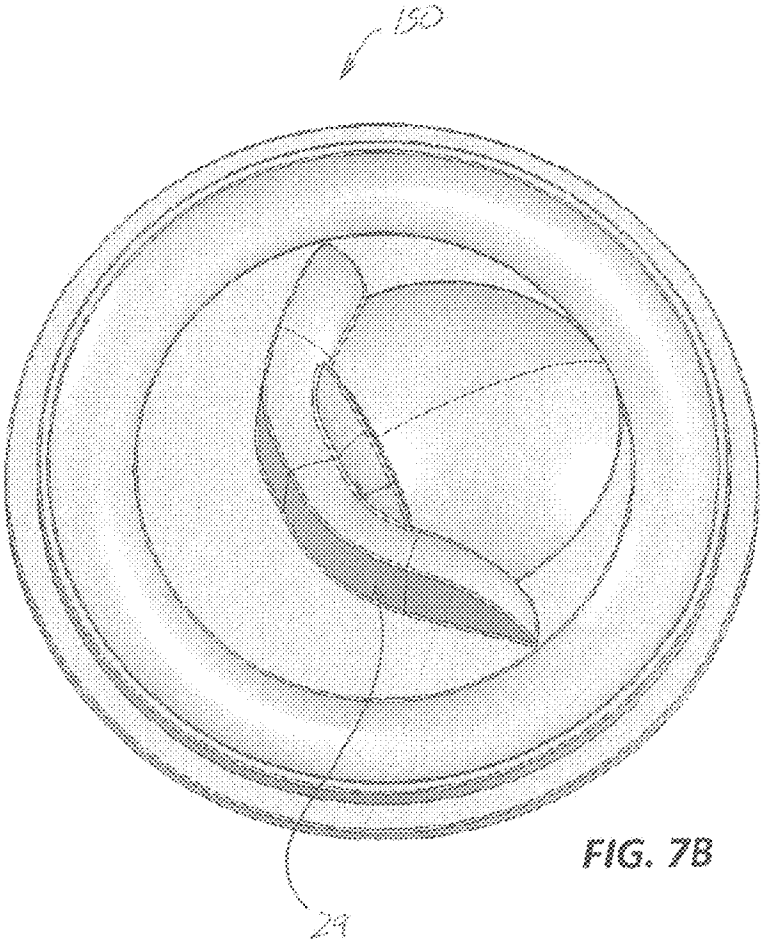
FIGS. 7A and 7B respectively illustrate a rotatable light module with and without a light-blocking shield according to some example embodiments of the present disclosure.
Figure 7A:
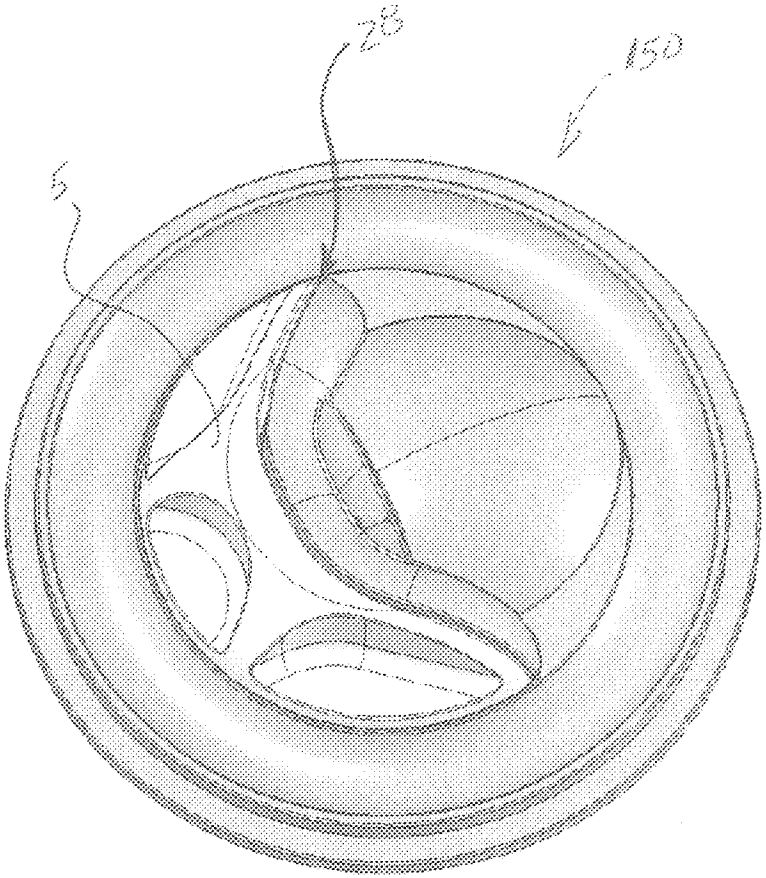

In accordance with some embodiments of the disclosure, FIG. 6A provides a perspective view of the rotatable light module 150, while FIG. 6B provides a plan view, FIG. 6C provides one side view, and FIG. 6D provides another side view. FIGS. 7A and 7B provide perspective illustrations of the rotatable light module 150 with and without the light-blocking shield 5, respectively, in accordance with some embodiments of the disclosure.

Figure 8A:
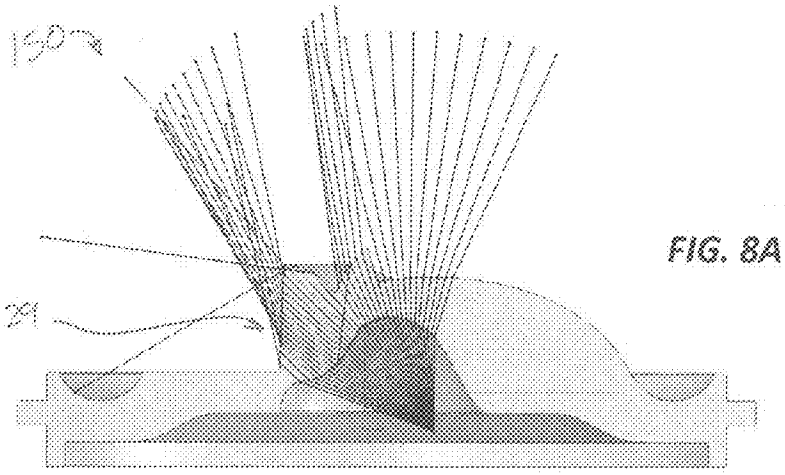
FIGS. 8A and 8B respectively illustrate cross sectional views of a rotatable light module with and without a light-blocking shield, with overlaid rays according to some example embodiments of the present disclosure.
Figure 8B:
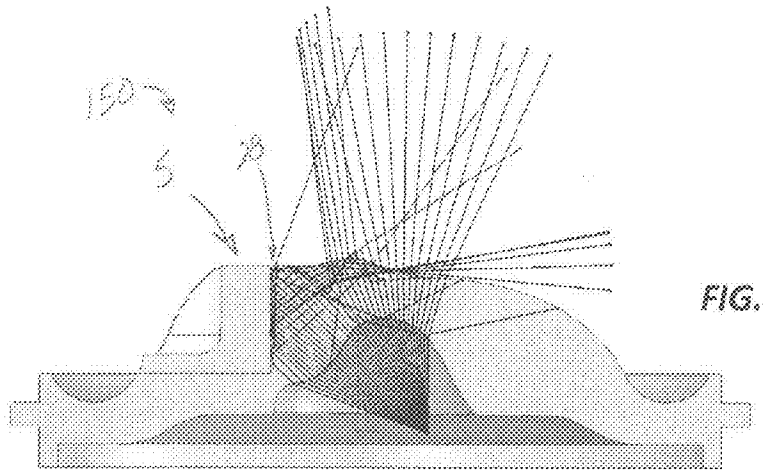

FIGS. 8A and 8B provide cross sectional views of the rotatable light module 150 with and without the light-blocking shield 5, respectively, with overlaid rays describing an example operation of the light-blocking shield 5 in accordance with some embodiments of the disclosure. In some applications, optical performance of a luminaire benefits from increasing the amount light emitted in one lateral direction while reducing light spillage in an opposing lateral direction. Additional benefit can be realized by using a rotatable light module 150 that concentrates the illumination in a particular, user-defined lateral direction. The embodiment of the rotatable light module 150 illustrated in FIGS. 6, 7, and 8 can address both of these objectives. In particular, the rotatable light module 150 incorporates the light-blocking shield 5. In the illustrated example embodiment, the light-blocking shield 5 comprises a single, external, permanently attached opaque element that not only suppresses unintended light traveling outside an aiming direction, but also redirects such light towards the aiming direction. As illustrated, the light-blocking shield 5 comprises finger-sized indentations 11 that serve as gripping features for easy manual rotation without a user touching refractive optical surfaces of the optic 180.

As illustrated, the optic 180 comprises a clear element, which may be formed from optical plastic for example, installed over the light emitting diode 175 as illustrated in FIG. 5 and discussed above. As illustrated in FIG. 8, the optic 180 produces illumination concentrated in a relatively tight angular zone. In some embodiments, the illumination may be concentrated so that over half of the illumination is within a range of substantially less than 180 degrees, for example. In some embodiments, the illumination may be concentrated within a range of approximately 120 degrees, for example. In some embodiments, the illumination may be concentrated within a range of approximately 100 degrees or less, for example.

As illustrated, the optic 180 is free to rotate a full 360 degrees so that a user can aim the beam toward a desired direction. A user may further rotate the optic 180 multiple revolutions clockwise or counterclockwise, for example. Light that the light emitting diode 175 emits opposite the desired direction is largely managed and redirected through total internal reflection of the optic 180.

To address spill light that bypasses the total internal reflection of the optic 180, the optic 180 comprises the light-blocking shield 5. The light-blocking shield 5 may be attached to the main, clear body of the optic 180 by fusion, welding, epoxy, fasteners, or other appropriate technology, for example. In an example embodiment, the light-blocking shield 5 comprises a high-reflectance diffuse material that avoids excessive light loss due to absorption. The light-blocking shield 5 can comprise opaque material. In some example embodiments, the light-blocking shield 5 comprises a molded plastic that is loaded with light-scattering material. In some example embodiments, the light-blocking shield 5 comprises a textured metal surface that diffusely reflects incident light.

FIG. 8A provides a cross section side view of the optic 180 without the light-blocking shield 5, showing a raytrace plane in which the rear side of the optic 180 is not completely reflecting all incident light through total internal reflection. The rays of light are spilling out the rear of the optic 180 in an unintended direction.

FIG. 8B provides a cross section side view of the optic 180 with the light-blocking shield 5, also showing a raytrace plane in which the rear side of the optic 180 is not completely reflecting all incident light through total internal reflection. However, the rays of light are reflected by the light-blocking shield and redirected toward the forward zone, rather than spilling out the rear in an unintended direction.

As illustrated in FIG. 8B, light rays that penetrate the totally internally reflective surface 29 propagate through the air gap 28 and are incident on the light-blocking shield 5. The light-blocking shield 5 reflects the incident light rays. The reflected light rays propagate back through the air gap 28 and into the optic 180. The optic 180 then returns the redirected light rays in the direction that the user desires.

In addition to its optical function, the light-blocking shield 5 provides an ergonomic grip for a user to rotate the optic 180 is as desired. In the illustrated embodiment, the light-blocking shield 5 comprises three indentations 11 that are sized to receive a user's fingertips to facilitate manual rotation. Thus in some embodiments, the indentations 11 can be characterized as finger receptacles.

Turning now to FIG. 9, this figure illustrates a perspective of an example luminaire 900 comprising three recessed light modules 901, 902, 903 according to some embodiments of the present disclosure. The luminaire 900 is configured for overhead mounting, such as on an eave of a house or other building or structure.

Each of the recessed light modules 901, 902, 903 comprises a light emitting diode mounted at the rear of a reflective cavity. The reflective cavities can be formed from reflective panels mounted to a frame 905, for example.

In an example embodiment, the reflective panels are formed so that the cavities emit light in a preferential lateral direction, resulting in an overall illumination pattern 913 that is biased to one side of the luminaire 900. As illustrated, one edge 911 of the illumination pattern 913 is directed more toward the ground than the other edge 912. That is, the edge 912 spreads horizontally more than the edge 911. The edge 911 may face the house, while the edge 912 is projects towards a yard to extend illumination coverage into the yard.

Turning now to FIG. 10, views of an example luminaire 100 comprising two example light modules 1050 are illustrated in accordance with some embodiments of the present disclosure. FIG. 10B illustrates the luminaire 110 with reflectors 1055, while FIG. 10A illustrates the luminaire 110 without the reflectors 1055. FIGS. 10C and 10D provide magnified views of the light module 1050, respectively without and with the reflector 1055.

In the illustrated embodiment, the light module 1050 is flat and recessed within the platform 115 of the luminaire 1000. The recessed light modules 1050 are typically fixed in position in the platform 115. In an example embodiment, light emits from each light module 1050 in a pattern that is substantially rotationally symmetric about an optical axis.

In an example embodiment, each light module 1050 comprises one or more light emitting diodes 175 (not visible in FIG. 10) and a cover lens 1051 or other optical element.

Figure 10A:
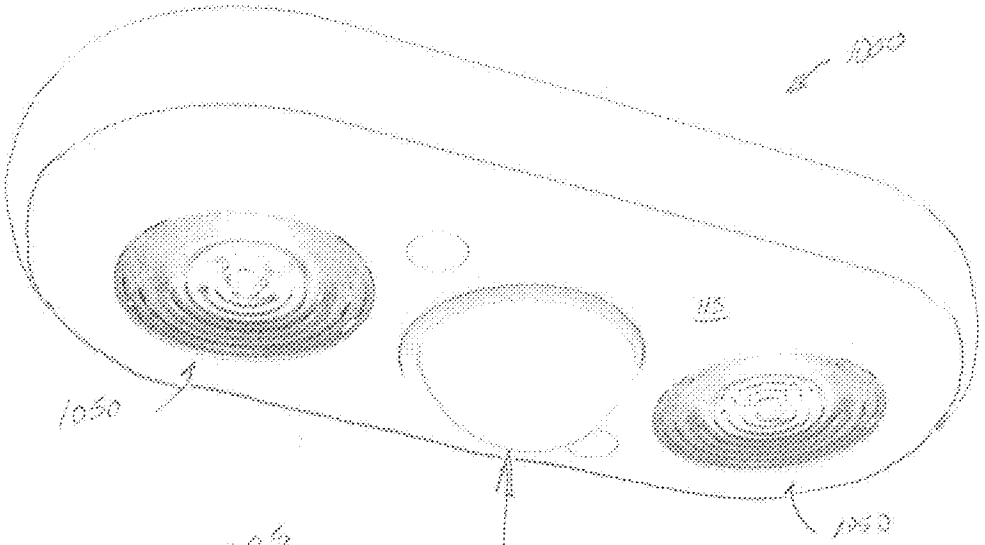
FIGS. 10A, 10B, 10C, and 10D (collectively FIG. 10) illustrate views of a luminaire comprising two light modules according to some example embodiments of the present disclosure.
Figure 10B:
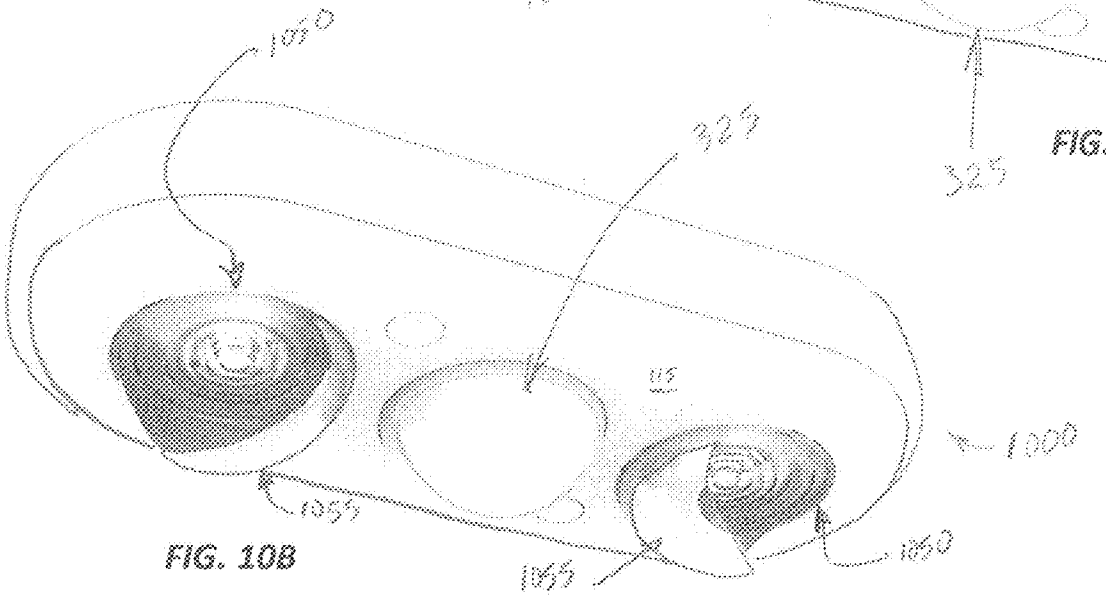
Figure 10C:
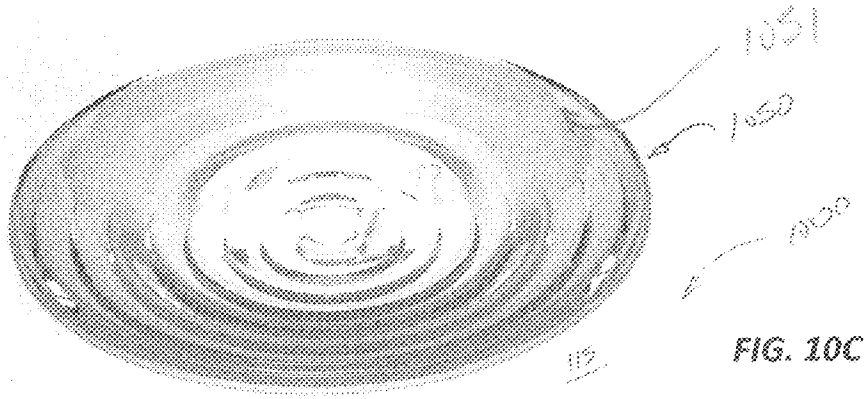
Figure 10D:
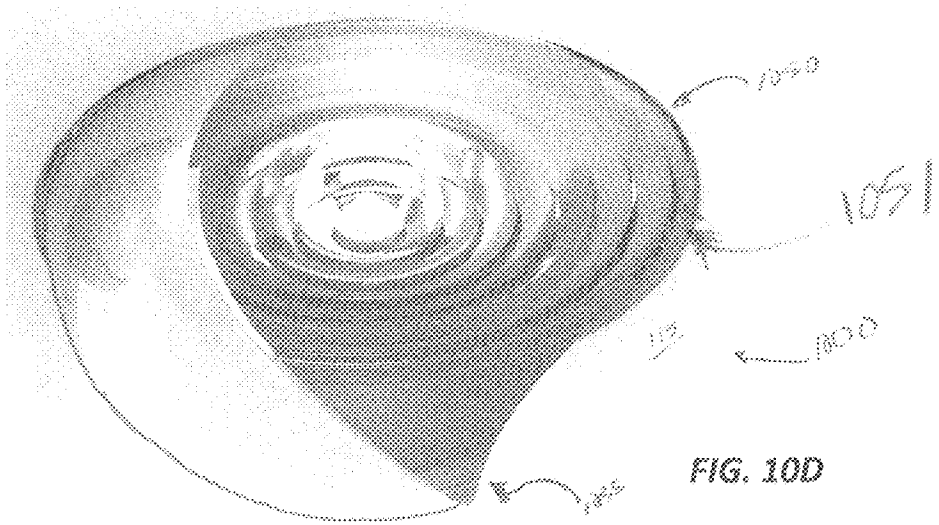

As illustrated in FIGS. 10B and 10D, each light module 1050 has an associated reflector 1055 that directs emitted light laterally. A user can aim the emitted light in one or more selected directions by rotating the reflectors 1055 around a periphery of the associated recessed light module 1050 as desired. The user may thus produce customized patterns of light as discussed above with reference to FIGS. 1 through 8. As an alternative to being rotatable, in some embodiments, the reflectors 1055 are set in fixed positions during manufacture of the luminaire 1000.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A lighting system comprising:
a light emitting diode comprising an optical axis;
an optic disposed adjacent the light emitting diode and comprising:
a cavity through which the optical axis extends; and
a prism that juts from the optic opposite the cavity, the prism disposed on one side of the optical axis and configured to receive light from the light emitting diode and to direct the received light across the optical axis; and
a light-blocking shield adjoining the optic, the prism disposed between the optical axis and the light-blocking shield.

2. The lighting system of claim 1, wherein the light-blocking shield comprises an indentation sized to receive a user finger.

3. The lighting system of claim 1, wherein the light-blocking shield comprises a plurality of indentations, and
wherein the optic is rotatable relative to the light emitting diode by applying rotational force at the plurality of indentations.

4. The lighting system of claim 1, wherein the optic comprises a lip that circumscribes the cavity,
wherein the prism comprises a totally internally reflective surface that is configured to receive the light from the light emitting diode and to direct the received light across the optical axis in an aiming direction,
wherein the light-blocking shield is attached to the optic to form a rotatable module, and
wherein a reflective surface of the light-blocking shield extends adjacent the totally internally reflective surface and is oriented to redirect in the aiming direction light that passes through the totally internally reflective surface.

5. The lighting system of claim 4, further comprising a frame,
wherein the optic is disposed in an aperture of the frame, and
wherein the lip captures the optic in the aperture.

6. The lighting system of claim 5, further comprising a gasket disposed adjacent the aperture, between the lip and the frame.

7. The lighting system of claim 1, wherein the optic comprises a rotatable optic that is sealed to a weatherproof enclosure.

8. A lighting system comprising:
an enclosure comprising an aperture that comprises an edge that extends around the aperture;
an optic that is disposed in the aperture, that rotates about an axis, and that comprises:
a lip that extends radially beyond the edge of the aperture; and
a reflector that directs light across the axis to produce an illumination pattern that is biased relative to the axis, the illumination pattern rotating as the optic rotates;
a light-blocking shield, wherein the reflector is disposed between the light-blocking shield and the axis; and
a gasket disposed between the edge and the lip.

9. The lighting system of claim 8, wherein the gasket provides an environmental seal.

10. The lighting system of claim 8, wherein the optic rotates relative to the gasket.

11. The lighting system of claim 8, further comprising a light emitting diode mounted to a heat sink adjacent the optic,
wherein the optic rotates relative to the light emitting diode and the heat sink,
wherein a thermal path leads from the light emitting diode into the heat sink and extends away from the optic, and
wherein the enclosure comprises the heat sink.

12. The lighting system of claim 8, wherein the lip is sandwiched between the gasket and a washer.

13. The lighting system of claim 8, wherein the light-blocking shield comprises a plurality of indentations sized to facilitate hand rotation of the optic.

14. A system comprising:
an enclosure comprising an aperture; and
an optic that is disposed in the aperture, that rotates about a central portion of the aperture, and that comprises:
a reflector that directs light across the central portion of the aperture; and
a light-blocking shield that is disposed adjacent the reflector to block light that bypasses the reflector, the reflector disposed between the light-blocking shield and the central portion of the aperture.

15. The system of claim 14, wherein the light-blocking shield comprises a plurality of finger receptacles to facilitate rotation of the optic.

16. The system of claim 14, wherein the light-blocking shield comprises opaque material, wherein the reflector comprises a totally internally reflective surface that directs the light across the central portion of the aperture in an aiming direction, wherein the light-blocking shield is attached to the optic as a rotatable unit, and wherein a reflective surface of the light-blocking shield extends adjacent the totally internally reflective surface and is oriented to redirect in the aiming direction light that passes through the totally internally reflective surface.

17. The system of claim 14, wherein the optic rotates about an axis that extends through the central portion of the aperture, and wherein the reflector is disposed between the axis and the light-blocking shield.

18. The system of claim 14, wherein the optic comprises a cavity that is configured to receive light from one or more light emitting diodes, wherein the reflector comprises a totally internally reflective surface, wherein the totally internally reflective surface protrudes from the optic, and wherein the enclosure is environmentally sealed.

19. The system of claim 14, wherein the aperture has a first diameter, wherein the optic further comprises a lip having a second diameter, wherein the second diameter is larger than the first diameter, wherein the system further comprises a ring disposed adjacent the lip, and wherein the ring protects the enclosure from moisture incursion.

* * * * *